US008035569B2

(12) United States Patent
Maruko et al.

(10) Patent No.: US 8,035,569 B2
(45) Date of Patent: Oct. 11, 2011

(54) ANTENNA CORE AND ANTENNA

(75) Inventors: Nobuhiro Maruko, Ichihara (JP); Kunihiro Inada, Sodegaura (JP); Takehiko Omi, Chiba (JP); Mitsunobu Yoshida, Ichihara (JP); Hiroshi Watanabe, Odawara (JP)

(73) Assignee: Mitsui Chemicals, Inc., Minato-Ku, Tokyo (JP)

( * ) Notice: Subject to any disclaimer, the term of this patent is extended or adjusted under 35 U.S.C. 154(b) by 314 days.

(21) Appl. No.: 12/373,526

(22) PCT Filed: Aug. 9, 2007

(86) PCT No.: PCT/JP2007/000857

§ 371 (c)(1),
(2), (4) Date: Jan. 13, 2009

(87) PCT Pub. No.: WO2008/018179

PCT Pub. Date: Feb. 14, 2008

(65) Prior Publication Data

US 2009/0267855 A1 Oct. 29, 2009

(30) Foreign Application Priority Data

Aug. 11, 2006 (JP) ..... 2006-220533

(51) Int. Cl.
*H01Q 1/00* (2006.01)

(52) U.S. Cl. ..... 343/787; 343/788

(58) Field of Classification Search ..... 343/787, 343/788, 702; 428/403, 404, 405, 692.1
See application file for complete search history.

(56) References Cited

U.S. PATENT DOCUMENTS 5,469,140 A 11/1995 Liu et al.
5,495,230 A 2/1996 Lian
5,565,849 A 10/1996 Ho et al.
5,567,537 A 10/1996 Yoshizawa et al.
5,568,125 A 10/1996 Liu
5,676,767 A 10/1997 Liu et al.
(Continued)

FOREIGN PATENT DOCUMENTS

EP 1 592 085 A1 11/2005
(Continued)

OTHER PUBLICATIONS

Official Action dated Jun. 1, 2010 issued in corresponding Japanese Patent Application No. 2008-528722.

(Continued)

*Primary Examiner* — Hoang V Nguyen
(74) *Attorney, Agent, or Firm* — Buchanan Ingersoll & Rooney PC

(57) ABSTRACT

An antenna core produced by shaping a soft magnetic metal powder with the use of a resin as a binder, wherein the soft magnetic metal powder is an amorphous soft magnetic metal powder or a nanocrystal-containing amorphous soft magnetic metal powder, of the general formula (1): $(Fe_{1-x-y}Co_xNi_y)_{100-a-b-c}Si_aB_bM_c$ (1), and wherein the resin as a binder is a thermosetting resin. In the formula, M is at least one element selected from the group consisting of Nb, Mo, Zr, W, Ta, Hf, Ti, V, Cr, Mn, Y, Pd, Ru, Ga, Ge, C, P, Al, Cu, Au, Ag, Sn and Sb. Each of x and y is an atomic ratio and each of a, b and c an atomic %, satisfying the relationships: $0 \leqq x \leqq 1.0$, $0 \leqq y \leqq 0.5$, $0 \leqq x+y \leqq 1.0$, $0 \leqq a \leqq 24$, $1 \leqq b \leqq 30$, $0 \leqq c \leqq 30$ and $2 \leqq a+b \leqq 30$.

13 Claims, 1 Drawing Sheet

U.S. PATENT DOCUMENTS

| | | | | |
|---|---|---|---|---|
| 5,786,762 | A | 7/1998 | Liu | |
| 7,030,828 | B2 * | 4/2006 | Kato et al. | 343/788 |
| 7,132,019 | B2 * | 11/2006 | Koshiba et al. | 148/304 |
| 7,161,542 | B2 | 1/2007 | Endo et al. | |
| 7,167,140 | B2 * | 1/2007 | Kato et al. | 343/788 |
| 7,195,717 | B2 | 3/2007 | Ishida et al. | |
| 7,553,562 | B2 * | 6/2009 | Otsuka | 428/692.1 |
| 2003/0077448 | A1 * | 4/2003 | Ueta et al. | 428/403 |
| 2005/0237254 | A1 | 10/2005 | Kato et al. | |
| 2007/0069961 | A1 * | 3/2007 | Akiho et al. | 343/702 |

FOREIGN PATENT DOCUMENTS

| | | | |
|---|---|---|---|
| JP | 61-219109 | A | 9/1986 |
| JP | 02039504 | * | 2/1990 |
| JP | 07-278763 | A | 10/1995 |
| JP | 08-034145 | B | 3/1996 |
| JP | 11-214209 | A | 8/1999 |
| JP | 2000232014 | * | 8/2000 |
| JP | 2002-290131 | A | 10/2002 |
| JP | 2004-179270 | A | 6/2004 |
| JP | 2004-197009 | A | 7/2004 |
| JP | 2005-057444 | A | 3/2005 |
| JP | 2005-064468 | A | 3/2005 |
| JP | 2005-116959 | A | 4/2005 |
| JP | 2005-171002 | A | 6/2005 |
| JP | 2005-236858 | A | 9/2005 |
| JP | 2005-317674 | A | 11/2005 |
| JP | 2005-333516 | A | 12/2005 |
| JP | 2006-060432 | A | 3/2006 |
| JP | 2006-126901 | A | 5/2006 |
| JP | 2006-164083 | A | 6/2006 |
| JP | 2006-191525 | A | 7/2006 |
| JP | 2006-206420 | A | 8/2006 |
| RU | 2 121 200 | C1 | 10/1998 |
| RU | 2 126 553 | C1 | 2/1999 |
| RU | 22392500 | C2 | 10/2004 |
| RU | 2 269 174 | C2 | 1/2006 |
| RU | 2271568 | C1 | 3/2006 |
| WO | WO 03/060175 | A1 | 7/2003 |

OTHER PUBLICATIONS

Form PCT/ISA/210 (International Search Report) dated Sep. 18, 2007.

Decision on Grant Patent for Invention from Russian Patent Office issued in Applicant's corresponding Russian Patent Application No. 2009108623/07 dated Aug. 26, 2010, with English Translation.

Supplementary Search Report issued Mar. 29, 2011, in European Patent Application No. 07 79 0345.

Office Action from Korean Patent Office issued in corresponding Korean Patent Application No. 20097004979 dated Mar. 9, 2011.

* cited by examiner

ANTENNA CORE AND ANTENNA

TECHNICAL FIELD

The present invention relates to an antenna core formed by shaping a specific soft magnetic metal powder with the use of a thermosetting resin and an antenna formed by winding a conductor around this antenna core.

BACKGROUND ART

There has been known an antenna core formed by shaping a soft magnetic metal powder with the use of a resin as a binder in view of easy shape machining.

In Patent Document 1, there has been disclosed an antenna core excellent in magnetic characteristics employing a nanocrystal magnetic powder or the like with the use of a thermoplastic resin as a binder. However, since an antenna core is produced by a hot press method with the use of a thermoplastic resin as a binder, an antenna core is not taken out from a mold if it is not fully cooled. Accordingly, when an antenna core is continuously produced, there is a problem such that it takes time for cooling, resulting in a poor productivity.

In Patent Document 1, a resin used as a binder is limited to a thermoplastic resin, while the Tg range of a thermoplastic resin, the range of mixing ratio of a magnetic powder and a thermoplastic resin, and the press pressure at a hot press procedure are further limited. All of these limitations are to improve soft magnetic characteristics of a magnetic powder or to prevent soft magnetic characteristics from being deteriorated by applying the unnecessarily higher pressure to the magnetic powder. That is, in the conventional technical knowledge, when a thermosetting resin is used as a binder, soft magnetic characteristics of the magnetic powder are considered to be deteriorated due to shrinkage stress of a resin during a curing process. Accordingly, in order to avoid such deterioration, a thermoplastic resin is used, while the Tg range of a thermoplastic resin, the range of mixing ratio of a magnetic powder and a thermoplastic resin, and the range of press pressure at a hot press procedure are further limited.

In Patent Document 2, there has been disclosed an antenna core excellent in impact resistance composed of an insulating soft magnetic material having various soft magnetic metal powders and various organic binders. However, in Patent Document 2, there has been described only the use of "a Fe—Al—Si alloy powder" and "a polyurethane resin as an organic binder", and "such a core is produced by laminating a sheet-like core material having a thickness of 1 mm, that is, a sheet," but details of the soft magnetic metal powder and the organic binder are not disclosed. Accordingly, respective details of the soft magnetic metal powder and the organic binder used for the antenna core are not clear.

Patent Document 1: Japanese Patent Laid-open No. 2004-179270

Patent Document 2: Japanese Patent Laid-open No. 2005-317674

DISCLOSURE OF THE INVENTION

An object of the present invention is to efficiently produce an antenna core which has a high performance and easy shape machining. In particular, another object is to propose an antenna core capable of industrially continuous production at a low cost in a short takt time when an antenna core formed by shaping a soft magnetic metal powder is produced with the use of a resin as a binder.

Meanwhile, another object is to provide an antenna core which is suitable for use in an antenna which does not deteriorate soft magnetic characteristics even when a thermosetting resin is used as a binder.

In order to solve the above objects, the present inventors have repeatedly conducted an extensive study and as a result, have found that magnetic characteristics of a soft magnetic metal powder are not deteriorated under specific production conditions even when a thermosetting resin is used as a binder. Namely, they have found that deterioration of soft magnetic characteristics can be suppressed and the productivity can be enhanced by combination of a specific soft magnetic metal powder and a thermosetting resin. Accordingly, in the present invention, it is possible to continuously produce an antenna core having practical sensitivity with good efficiency.

Namely, the present invention relates to an antenna core produced by shaping a soft magnetic metal powder with the use of a thermosetting resin as a binder, wherein the soft magnetic metal powder is an amorphous soft magnetic metal powder or a nanocrystal-containing amorphous soft magnetic metal powder represented by the general formula (1) below, and the resin used as a binder is a thermosetting resin, $$(Fe_{1-x-y}Co_xNi_y)_{100-a-b-c}Si_aB_bM_c \quad (1)$$

wherein, in the formula, M is at least one element selected from the group consisting of Nb, Mo, Zr, W, Ta, Hf, Ti, V, Cr, Mn, Y, Pd, Ru, Ga, Ge, C, P, Al, Cu, Au, Ag, Sn and Sb; and each of x and y represents an atomic ratio and each of a, b and c represents an atomic %, satisfying the relationships: $0 \leqq x \leqq 1.0$, $0 \leqq y \leqq 0.5$, $0 \leqq x+y \leqq 1.0$, $0 \leqq a \leqq 24$, $1 \leqq b \leqq 30$, $0 \leqq c \leqq 30$ and $2 \leqq a+b \leqq 30$.

According to the present invention, provided is an antenna core excellent in shape machining property and magnetic characteristics, and capable of industrially continuous production at a low cost in a short takt time. An antenna formed by winding a conductor around the antenna core of the present invention is excellent in performance and cheap.

BRIEF DESCRIPTION OF THE DRAWINGS

The above and other objects, features and advantages will be apparent from the following detailed description of the preferred embodiments in conjunction with the accompanying drawings.

BEST MODE FOR CARRYING OUT THE INVENTION

Figure 1:
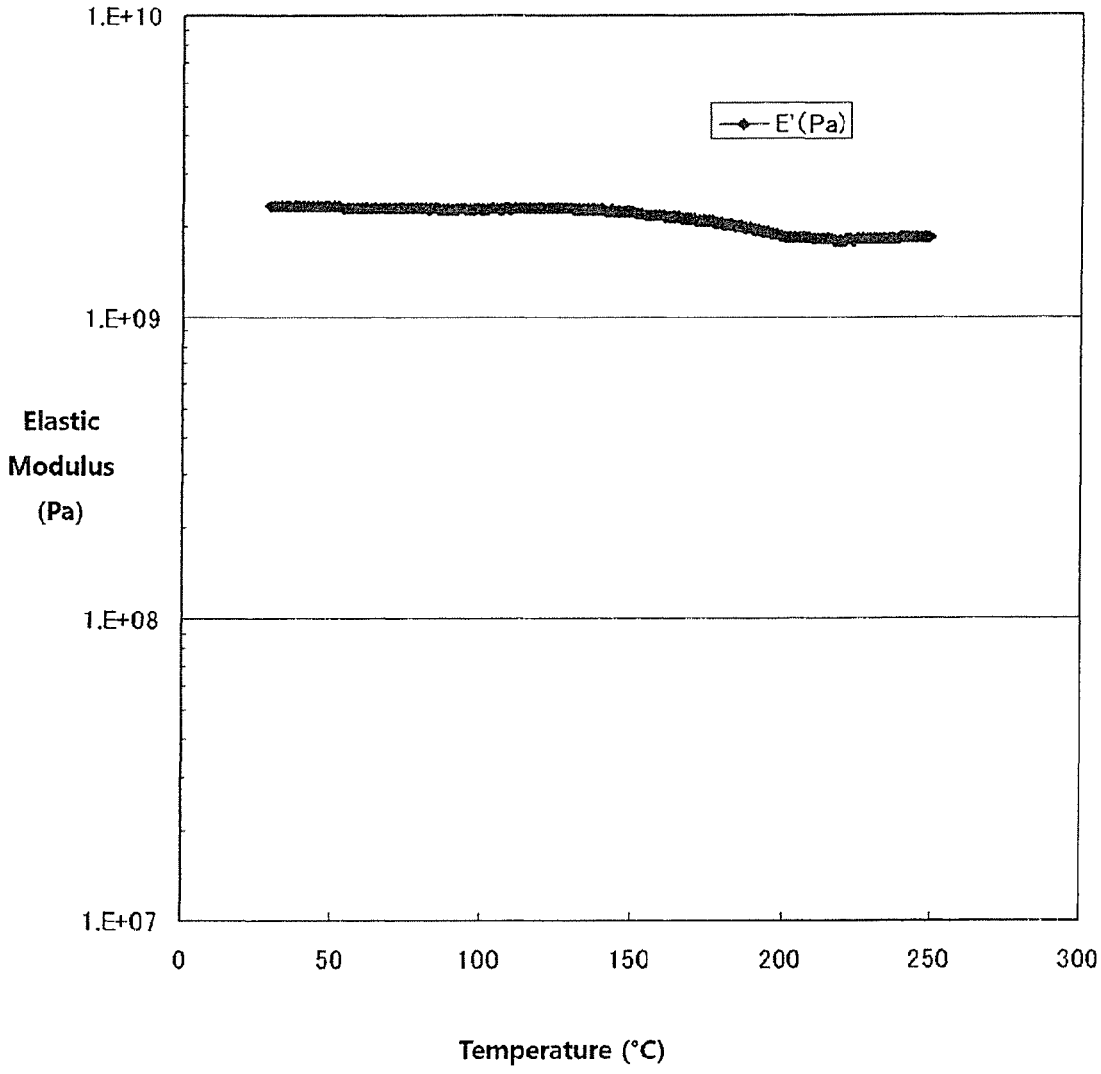
FIG. 1 is a view illustrating the relationship between the temperature and the storage elastic modulus E' (Pa) of the antenna core of the present invention.

The soft magnetic metal powder used for the present invention is represented by the general formula (1): $(Fe_{1-x-y}Co_xNi_y)_{100-a-b-c}Si_aB_bM_c$ (1). Herein, in the formula (1), M is at least one element selected from the group consisting of Nb, Mo, Zr, W, Ta, Hf, Ti, V, Cr, Mn, Y, Pd, Ru, Ga, Ge, C, P, Al, Cu, Au, Ag, Sn and Sb. Furthermore, each of x and y represents an atomic ratio and each of a, b and c represents an atomic %, satisfying the relationships: $0 \leqq x \leqq 1.0$, $0 \leqq y \leqq 0.5$, $0 \leqq x+y \leqq 1.0$, $0 \leqq a \leqq 24$, $1 \leqq b \leqq 30$, $0 \leqq c \leqq 30$ and $2 \leqq a+b \leqq 30$. Furthermore, the soft magnetic metal powder used for the present invention is an amorphous soft magnetic metal powder or a nanocrystal-containing amorphous soft magnetic metal powder.

Furthermore, the soft magnetic metal powder used for the present invention is preferably represented by the general formula (2): $(Fe_{1-x}M'_x)_{100-a-b-c-d}Si_aAl_bB_cM_d$ (2). Herein, in the formula (2), M' is Co and/or Ni, while M represents at least one element selected from the group consisting of Nb, Mo, Zr, W, Ta, Hf, Ti, V, Cr, Mn, Y, Pd, Ru, Ga, Ge, C, P, Cu, Au, Ag, Sn and Sb. X represents an atomic ratio, and each of a, b, c and d represents an atomic %. Furthermore, each of them satisfies $0 \leqq x \leqq 0.5$, $0 \leqq a \leqq 24$, $0 \leqq b \leqq 20$, $1 \leqq c \leqq 30$, $0 \leqq d \leqq 10$ and $2 \leqq a+c \leqq 30$. Furthermore, such a soft magnetic metal powder is a nanocrystal-containing amorphous soft magnetic metal powder.

In the general formula (2), the content of Si is from 0 to 24 atomic %, preferably from 4 to 18 atomic % and further preferably from 6 to 16 atomic %. By having the content of Si within this range, the crystallization speed becomes slow for easily forming an amorphous phase.

In the general formula (2), the content of B is from 1 to 30 atomic %, preferably from 2 to 20 atomic % and further preferably from 4 to 18 atomic %. By having the content of B within this range, the crystallization speed becomes slow for easily forming an amorphous phase. Furthermore, when the content of B is higher than 9 atomic %, an amorphous phase can be stabilized by adding Al.

Furthermore, the soft magnetic metal powder used for the present invention may be preferably represented by the general formula (3): $(Co_{1-x}M'_x)_{100-a-b-c}Si_aB_bM_c$ (3). Herein, in the formula (3), M' is Fe and/or Ni, while M represents at least one element selected from the group consisting of Nb, Mo, Zr, W, Ta, Hf, Ti, V, Cr, Mn, Y, Pd, Ru, Ga, Ge, C, P, Al, Cu, Au, Ag, Sn and Sb. X represents an atomic ratio, and each of a, b and c represents an atomic %. Furthermore, each of them satisfies $0 \leqq x \leqq 0.3$, $0 \leqq a \leqq 24$, $4 \leqq b \leqq 30$, $0 \leqq c \leqq 10$ and $4 \leqq a+b \leqq 30$. Furthermore, such a soft magnetic metal powder is an amorphous soft magnetic metal powder exhibiting only a halo pattern where no clear diffraction peak is present in the powder X-ray diffraction.

In the general formula (3), the substitution amount x is $0 \leqq x \leqq 0.3$, preferably $0 \leqq x \leqq 0.2$ and further preferably $0 \leqq x \leqq 0.1$. By having the substitution amount x within such a range, there is an effect such that the magnetic permeability is enhanced for reducing the iron loss or the like.

In the general formula (3), the content of Si is from 0 to 24 atomic %, preferably from 4 to 18 atomic % and further preferably from 6 to 16 atomic %. By having the content of Si within this range, the crystallization speed becomes slow for easily forming an amorphous phase.

In the general formula (3), the content of B is from 4 to 30 atomic %, preferably from 4 to 20 atomic % and further preferably from 6 to 18 atomic %. By having the content of B within this range, the crystallization speed becomes slow for easily forming an amorphous phase.

Furthermore, in the general formulae (1) to (3), the total content of Si and B is preferably not more than 30 atomic %. Herein, the lower limit of the total content of Si and B is preferably not less than 2 atomic % in case of the nanocrystal-containing amorphous soft magnetic metal powder. Furthermore, when an amorphous soft magnetic metal powder contains no nanocrystal, it is preferably not less than 4 atomic %. When the total content of Si and B is excessively small, the crystallization speed becomes fast so that there is a possibility that an amorphous phase may be hardly formed. On the other hand, when the content of Si and B is excessively high, the content of magnetic elements such as Fe, Co and Ni becomes relatively small so that there is a possibility that good magnetic characteristics may be hardly achieved.

In the composition represented by the above general formulae (1) to (3), Fe, Co and Ni are main magnetic elements exhibiting a soft magnetic property. Furthermore, Si and B are essential components for forming an amorphous phase.

Furthermore, in the general formulae (1) to (3), when Cu and/or Al are contained, growth of nanocrystal is accelerated. Accordingly, Cu or Al, or both Cu and Al is preferably contained. When Cu is mainly added, the amount of Cu added is, for example, from 0.1 to 3 atomic % and more preferably from 0.5 to 2 atomic %. When Al is mainly added, the amount of Al added is, for example, from 2 to 15 atomic % and more preferably from 3 to 12 atomic %. When a main magnetic element exhibiting a soft magnetic property is composed of Fe alone, the content of Al is preferably from 6 to 12 atomic % and more preferably from 7 to 10 atomic %. In this case, in particular, it is possible to obtain an antenna core material which has increased magnetic permeability and decreased iron loss.

As other elements which may be contained in the general formulae (1) to (3), there can be exemplified Nb, Mo, Zr, W, Ta, Hf, Ti, V, Cr, Mn, Y, Pd, Ru, Ga, Ge, C, P, Al and the like. These elements can be suitably added for imparting corrosion resistance to magnetic metals and improving magnetic characteristics. Of these elements, Nb, W, Ta, Zr, Hf and Mo are, in particular, effective in suppression of deterioration of soft magnetic characteristics of a magnetic metal powder. Furthermore, V, Cr, Mn, Y and Ru are effective in improvement of corrosion resistance of a magnetic metal powder. C, Ge, P and Ga are effective in stabilization of an amorphous phase. When elements having particularly excellent effects among these elements are exemplified, Nb, Ta, W, Mn, Mo and V are preferred. In particular, when Nb is added, it is particularly effective in improvement of coercive force, magnetic permeability, iron loss and the like among soft magnetic characteristics. The amount of these elements added is preferably from 0 to 10 atomic %, more preferably from 0 to 8 atomic % and further preferably from 0 to 6 atomic %.

An amorphous soft magnetic metal powder can be obtained according to the following method using a metal raw material combined so as to have a desired composition. For example, a metal raw material is melted at a high temperature by using a high frequency melting furnace or the like to give a uniform molten metal which is then quickly cooled, whereby the amorphous soft magnetic metal powder can be obtained. Alternatively, a thin band-like amorphous soft magnetic metal material is obtained by blowing a molten metal of a metal raw material against a rotating cooling roll, which is then pulverized, whereby an amorphous soft magnetic metal powder may also be produced. Furthermore, a granular amorphous soft magnetic metal powder is compressed by a roll, whereby a flattened amorphous soft magnetic metal powder may also be obtained. However, since magnetic characteristics of the amorphous soft magnetic metal powder are deteriorated due to a stress during pulverization or compression in these methods, a method which is not affected by a stress as much as possible is preferred. For example, a water-atomization method and a gas-atomization method are preferably used. According to these methods, a molten metal can be quickly cooled directly to form a powder, and an amorphous soft magnetic metal powder which is not affected by a stress can be obtained. Furthermore, when the gas-atomization method is used, a size-reduced particle by gas is allowed to collide against a rotating cooler in a conical shape, whereby a flattened amorphous soft magnetic metal powder to be described below may be produced. Alternatively, magnetic characteristics lowered due to a stress caused by pulverization or compression can be recovered or enhanced by heat treatment to be described below. However, since the amorphous magnetic metal powder becomes fragile due to heat treatment, the flattening treatment by compression with a roll or the like is preferably performed before heat treatment. When the amorphous magnetic metal powder which becomes fragile by performing heat treatment is pulverized, it is preferable to perform heat treatment again for eliminating distortion due to pulverization.

The amorphous soft magnetic metal powder used herein can be an amorphous soft magnetic metal powder with improved soft magnetic characteristics by performing heat treatment. The conditions of heat treatment depend on the composition of the magnetic metal powder, magnetic characteristics intended to be exhibited and the like. Accordingly, the conditions are not particularly limited. For example, the heat treatment is performed at a temperature of approximately from 300 to 500 degrees centigrade for several seconds to several hours. The heat treatment time is preferably from 1 second to 10 hours and more preferably from 10 seconds to 5 hours. Accordingly, soft magnetic characteristics can be improved. The heat treatment is preferably performed in an inert gas atmosphere.

Furthermore, the nanocrystal-containing amorphous soft magnetic metal powder can be produced by further performing suitable heat treatment to the aforementioned amorphous soft magnetic metal powder. The conditions of heat treatment depend on the composition of the magnetic metal powder, magnetic characteristics intended to be exhibited and the like. Accordingly, the conditions are not particularly limited. For example, the heat treatment is performed at a temperature higher than the crystallization temperature, approximately from 300 to 700 degrees centigrade and preferably from 400 to 650 degrees centigrade for 1 second to 10 hours and preferably for 10 seconds to 5 hours. Accordingly, the nanocrystal can be precipitated in the amorphous soft magnetic metal powder. Alternatively, the conditions depend on the composition of the amorphous soft magnetic metal powder. However, under specific heat treatment conditions, nanocrystallization and soft magnetic characteristics of the amorphous soft magnetic metal powder can be improved at the same time. Alternatively, heat treatment for improving soft magnetic characteristics may be performed after nanocrystallization. The heat treatment is preferably performed in an inert gas atmosphere.

Crystallinity of the soft magnetic metal powder can be easily quantitatively evaluated by measuring its powder X-ray diffraction. That is, in case of an amorphous state, a clear peak is not seen in the powder X-ray diffraction pattern, and only a broad halo pattern is observed. In a sample where a nanocrystal is present by performing heat treatment, a diffraction peak grows at a position corresponding to lattice spacing of the crystal face. The crystallite diameter can be calculated from the width of its diffraction peak using the Scherrer formula.

In general, a nanocrystal refers to the crystallite diameter of not more than 1 μm calculated from a half value width of the diffraction peak of the powder X-ray diffraction by the Scherrer formula. For the nanocrystal contained in the amorphous soft magnetic metal powder of the present invention, the crystallite diameter calculated from a half value width of the diffraction peak of the powder X-ray diffraction by the Scherrer formula is preferably not more than 100 nm, more preferably not more than 50 nm and further preferably not more than 30 nm. The lower limit of the above crystallite diameter is not particularly limited. However, when it is small, i.e., about several nanometers, sufficient accuracy is not possibly obtained. Accordingly, the crystallite diameter of the nanocrystal contained in the amorphous soft magnetic metal powder of the present invention is preferably not less than 5 nm. The crystallite diameter of the nanocrystal is in such a size, whereby improvement of soft magnetic characteristics such as small coercive force of the antenna core or the like is observed, thus improving antenna characteristics.

Incidentally, usually in a phase having such a nano-scale crystallite diameter, an amorphous phase is also present. When the crystallite diameter of the nanocrystal is excessively high, and the heat treatment is excessively performed to such an extent until the amorphous phase is no longer present, the crystal may possibly overgrow. Accordingly, the crystal cannot be already present as a fine nano-scale crystallite and it is not suitable for use as the antenna core of the present invention in some cases. Accordingly, from the viewpoint of suppression of deterioration of soft magnetic characteristics, it is preferable that the heat treatment is not excessively performed.

The soft magnetic metal powder used in the present invention may be in any shape such as a sphere, an acicula, a spheroid or an unshaped one. Particularly preferred is a flat shape. When it is flat, an unshaped powder can also be preferably used. Flatness includes, for example, a smooth disk shape, an oval-spherical shape or the like obtained by pressing and crushing a spherical shape. Further, a flat shape includes a pulverized powder and a small piece shape as well.

Furthermore, it is preferable that the soft magnetic metal powder used in the present invention has a flat shape with a ratio of a minor diameter to a thickness (minor diameter/thickness) of from 2 to 3,000. For example, it is preferable that the soft magnetic metal powder has a flat shape having an average thickness of not more than 25 μm. It is preferable that a flat powder has an average thickness of further preferably from 0.1 μm to 10 μm and an average minor diameter of from 1 to 300 μm. It is more preferable that the soft magnetic powder has an average thickness of from 0.5 to 5 μm and an average minor diameter of from 2 to 200 μm.

For the soft magnetic metal powder used in the present invention, powders in substantially same shapes may be used alone, or powders in different shapes may also be mixed in the ranges in which the effect of the present invention is exhibited.

For the soft magnetic metal powder used in the present invention, an amorphous soft magnetic metal powder or a nanocrystal-containing amorphous soft magnetic metal powder of a specific composition may also be used alone, or an amorphous soft magnetic metal powder or a nanocrystal-containing amorphous soft magnetic metal powder of a different composition may also be used in mixture. Further, an amorphous soft magnetic metal powder and a nanocrystal-containing amorphous soft magnetic metal powder may be used in mixture. Furthermore, other magnetic materials, for example, ferrite, sendust and the like, may also be used in mixture in the ranges in which the effect of the present invention is exhibited.

As an amorphous metal constituting the soft magnetic metal powder, a Fe based amorphous metal and a Co based amorphous metal can be used, though not restricted thereto. Among such metals, the Fe based amorphous metal is preferred because the maximum magnetic flux density is high. Examples thereof include Fe-metalloid based amorphous metals such as Fe—B—Si type, Fe—B type, Fe—P—C type and the like; and Fe-transition metal based amorphous metals such as Fe—Zr type, Fe—Hf type, Fe—Ti type and the like. As the Fe—Si—B based amorphous metal, there can be mentioned, for example, $Fe_{78}Si_9B_{13}$ (atomic %), $Fe_{78}Si_{10}B_{12}$ (atomic %), $Fe_{81}Si_{13.5}B_{3.5}C_2$ (atomic %), $Fe_{77}Si_5B_{16}Cr_2$ (atomic %), $Fe_{66}CO_{18}Si_1B_{15}$ (atomic %) $Fe_{74}Ni_4Si_2B_{17}Mo_3$ (atomic %) and the like. Among such metals, preferably used are $Fe_{78}Si_9B_{13}$ (atomic %) and $Fe_{77}Si_5B_{16}Cr_2$ (atomic %). Particularly preferably used is $Fe_{78}Si_9B_{13}$ (atomic %).

Table 1 illustrates examples of the soft magnetic metal powder which can be used in the present invention. Furthermore, an antenna core of 21 mm×3 mm×1 mm is produced in the same manner as in Example 1 to be described below using these soft magnetic metal powders, and the L value, Q value, and the product of L value and Q value measured in the same manner as in Example 1 are illustrated.

TABLE 1

| | L value [/mH] | Q value | L × Q value |
|---|---|---|---|
| $Fe_{73}Si_8Al_{10}B_9$ | 16.4 | 15 | 246 |
| $Fe_{67}Si_{12}Al_{12}B_9$ | 16.9 | 22 | 372 |
| $Fe_{67}Si_{16}Al_8B_9$ | 16.7 | 20 | 334 |
| $Fe_{68}Si_{14}Al_8B_9Nb_1$ | 17.3 | 45 | 779 |
| $Fe_{69}Si_{13}Al_4Nb_4B_{10}$ | 17.3 | 49 | 848 |
| $Fe_{61}Si_{13}Al_{12}Nb_4B_{10}$ | 17.4 | 60 | 1044 |
| $Fe_{60}Si_{12.8}Al_{7.2}Nb_6B_{14}$ | 17.4 | 52.5 | 914 |
| $Fe_{58}Si_{18}Al_{10}Nb_4B_{10}$ | 17.2 | 28 | 482 |
| $Fe_{75}Si_8Al_5Nb_3B_9$ | 17.1 | 32 | 547 |
| $Fe_{66}Si_8Al_5Nb_5B_{16}$ | 16.4 | 15 | 246 |
| $Fe_{66}Si_{14}Al_8Mo_3B_9$ | 17.4 | 62 | 1079 |
| $Fe_{66}Si_{14}Al_8Ta_3B_9$ | 17.4 | 70 | 1218 |
| $Fe_{66}Si_{14}Al_8Cr_3B_9$ | 17.2 | 32 | 550 |
| $Fe_{66}Si_{14}Al_8V_3B_9$ | 17.3 | 40 | 692 |
| $Fe_{66}Si_{14}Al_8Ti_3B_9$ | 17.3 | 47 | 813 |
| $Fe_{66}Si_{14}Al_8W_3B_9$ | 17.4 | 62 | 1079 |
| $Fe_{66}Si_{14}Al_8Mn_3B_9$ | 17.2 | 32 | 550 |
| $Fe_{66}Si_{14}Al_8Hf_3B_9$ | 17.4 | 56 | 974 |
| $Fe_{66}Si_{14}Al_8Zr_3B_9$ | 17.4 | 62 | 1079 |
| $Fe_{66}Si_{14}Al_8Y_3B_9$ | 17.3 | 44 | 761 |
| $Fe_{63}Si_{13}Al_7Nb_4Pd_3B_{10}$ | 17.4 | 53 | 922 |
| $Fe_{63}Si_{13}Al_6Nb_4Ru_4B_{10}$ | 17.4 | 42 | 731 |
| $Fe_{61}Si_{14}Al_8Zr_4B_9C_4$ | 17.3 | 44 | 761 |
| $Fe_{63}Si_{14}Al_6Zr_4B_{10}P_3$ | 17.3 | 31 | 536 |
| $Fe_{66}Ni_{1.6}Si_{14}Al_{6.4}Nb_3B_9$ | 17.4 | 53 | 922 |
| $Fe_{66}Ni_{5.5}Si_{14}Al_{2.5}Nb_3B_9$ | 17.3 | 40 | 692 |
| $Fe_{69.4}Ni_{2.4}Si_{9.6}Al_{6.6}Nb_3B_9$ | 17.4 | 53 | 922 |
| $Fe_{66}Ni_{2.8}Si_{11.2}Al_8Nb_3B_9$ | 17.4 | 53 | 922 |
| $Fe_{59}Ni_4Si_{13}Al_4Nb_6B_{14}$ | 17.4 | 53 | 922 |
| $Fe_{66}Co_{1.6}Si_{14}Al_{6.4}Nb_3B_9$ | 17.4 | 56 | 974 |
| $Fe_{66}Co_4Si_{14}Al_4Nb_3B_9$ | 17.2 | 42 | 722 |
| $Fe_{66}Co_{5.6}Si_{8.4}Al_8Nb_3B_9$ | 17.3 | 40 | 692 |
| $Fe_{73.5}Cu_1Nb_3Si_{13.5}B_9$ | 17.4 | 69 | 1201 |
| $Fe_{71.5}Cu_1Nb_5Si_{13.5}B_9$ | 17.4 | 70 | 1218 |
| $Fe_{73.5}Cu_1Mo_3Si_{13.5}B_9$ | 17.3 | 65 | 1125 |
| $Fe_{71.5}Cu_1Mo_5Si_{13.5}B_9$ | 17.4 | 67 | 1166 |
| $Fe_{76}Cu_1Ta_3Si_{12}B_8$ | 17.4 | 63 | 1096 |
| $Fe_{73.5}Cu_1Zr_3Si_{13.5}B_9$ | 17.3 | 61 | 1055 |
| $Fe_{73}Cu_1Hf_4Si_{14}B_8$ | 17.3 | 60 | 1038 |
| $Fe_{70.5}Cu_{1.5}Si_{15}B_9Nb_3Au_1$ | 17.4 | 66 | 1148 |
| $Fe_{69}Cu_1Si_{17}B_7Nb_5Ru_1$ | 17.4 | 66 | 1148 |
| $Fe_{71}Cu_1Si_{15}B_9Nb_3Ti_1$ | 17.4 | 69 | 1201 |
| $(Fe_{0.95}Co_{0.05})_{72}Cu_1Si_{14}B_9Nb_3Cr_1$ | 17.4 | 67 | 1166 |
| $Fe_{90}Zr_7B_3$ | 17.4 | 52 | 905 |
| $Fe_{84}Nb_7B_9$ | 17.4 | 54 | 940 |
| $Fe_{89}Hf_7B_4$ | 17.4 | 62 | 1079 |

The soft magnetic metal powder used in the present invention may be a soft magnetic metal powder subjected to a surface treatment using a coupling agent or the like in advance. Alternatively, the soft magnetic metal powder may be treated so as to insulate electric connection among soft magnetic metal powders using an insulating treating agent, or the soft magnetic metal powder may be used at a state that soft magnetic metal powders are electrically conducted to one another without conducting insulating treatment.

As the thermosetting resin used as a binder in the present invention, known thermosetting resins can be used. For example, an epoxy resin, a phenol resin, an unsaturated polyester resin, a urethane resin, a urea resin, a melamine resin, a silicon resin and the like are preferably used. Among such resins, an epoxy resin and a phenol resin are suitably used because they are excellent in the dimensional stability after molding. Further, in each resin, preferably used is a resin of a grade in which the curing rate is fast and which can be used in injection molding, transfer molding and the like.

These thermosetting resins are usually formed by employing two kinds of resins of a main agent and a curing agent, but a plurality of main agents and/or a plurality of curing agents may also be used. Furthermore, an additive agent such as a curing accelerator, a mold release agent or the like may be added such that the desired productivity is exhibited. The thermosetting resin used as a binder in the present invention may be used singly, or a plurality of different thermosetting resins may be used in combination. Also, as necessary, organic flame retardants such as a halide or the like may be used in combination.

The antenna core of the present invention has a high elastic modulus such that it is hardly deformed even at a high temperature. It is preferable that the storage elastic modulus E' at 80 degrees centigrade is from 0.1 to 20 GPa and further preferably from 0.5 to 10 GPa at a measurement frequency of 1.0 Hz. When the storage elastic modulus E' at 80 degrees centigrade is within such a range, an antenna core becomes hardly deformed even at a high temperature.

Meanwhile, the storage elastic modulus E' of the antenna core of the present invention is a high elastic modulus which is almost constant in the temperature range of from room temperature (30 degrees centigrade) to high temperature. Accordingly, for example, the storage elastic modulus E' at 30 degrees centigrade exhibits the same value as the storage elastic modulus E' at 80 degrees centigrade at a measurement frequency of 1.0 Hz, preferably from 0.1 20 GPa and further preferably from 0.5 to 10 GPa.

Furthermore, the storage elastic modulus E' at 100 degrees centigrade also exhibits the same value as the storage elastic modulus E' at 80 degrees centigrade at a measurement frequency of 1.0 Hz, preferably from 0.1 to 20 GPa and further preferably from 0.5 to 10 GPa.

In the present invention, to use a thermosetting resin as a binder, provided is an antenna core excellent in shape machining property, capable of industrially continuous production at a low cost in a short takt time. Furthermore, when the thermosetting resin is used as a binder in the past, it has been considered that soft magnetic characteristics of a magnetic powder are deteriorated. However, in the present invention, it is possible to provide an antenna core in which deterioration of magnetic characteristics is suppressed even with the use of a thermosetting resin by combining a specific soft magnetic metal and a thermosetting resin. Also, it is possible to obtain an antenna core which is hardly deformed even at a high temperature and excellent in the dimensional stability by combining a metal powder having a specific form factor and a thermosetting resin.

At the same time, it is possible to obtain an antenna core which is further excellent in magnetic characteristics.

As a method for forming an antenna core, there can be used various methods known from the past. For example, the antenna core of the present invention can be molded in the following manner.

First, a powder of the thermosetting resin used as a binder is mixed with a soft magnetic metal powder. Thereafter, the resulting mixture may be molded using various molding machines known from the past in the shape of a tablet, a pillar, a granule or a pellet, or a powder-like powder mixture per se may be molded using a molding machine.

The powder of the thermosetting resin used as a binder can be mixed with the soft magnetic metal powder in the following manner. First, respective powders of a main agent to be the thermosetting resin and a curing agent are mixed together. At this time, various mixing machines, mixers and the like known from the past can be used for mixing. To mix a main agent with a curing agent, as necessary, a curing accelerator, a mold release agent or the like is combined in a desired content. Next, this fully mixed powder of the thermosetting resin is mixed with the soft magnetic metal powder. Comparing to the mixture of a main agent of the thermosetting resin with a curing agent, when the thermosetting resin powder obtained by mixing a main agent and a curing agent is mixed with the soft magnetic metal powder, a difference in the specific gravity is great. Accordingly, mixing conditions need to be set up to give a fully uniform mixture. At this time, the soft magnetic metal powder may be subjected to a surface treatment or the like.

Finally, using a fully uniformly mixed powder mixture of the thermosetting resin powder and the soft magnetic metal powder, an antenna core is molded with a compression molding machine, a transfer molding machine, an injection molding machine or the like.

There are optimum conditions for molding respectively depending on the combination of the thermosetting resin in use, mixing with a soft magnetic metal powder or the like, but molding is usually performed in the temperature range of approximately from 50 to 300 degrees centigrade and preferably in the range of 100 to 200 degrees centigrade. The pressure during molding is, for example, in the range of 0.1 to 300 MPa and preferably in the range of 1 to 100 MPa.

The curing time is, for example, in the range of about 5 seconds to 2 hours, but it is preferable to adjust other molding conditions so as to be molded for 30 seconds to 10 minutes.

Furthermore, to complete curing of the thermosetting resin and/or to improve magnetic characteristics, an annealing process is preferably carried out after molding. The annealing conditions are different depending on the thermosetting resin in use. The annealing conditions are usually an applied pressure or a pressure-released state in the range that decomposition of the thermosetting resin can be allowed, the temperature range of 100 to 500 degrees centigrade for about 1 minute to 10 hours. Annealing may be performed inside a mold without taking out an antenna core from the mold, but may be preferably performed by taking out an antenna core from the mold. At this time, annealing is performed in an applied pressure or in a pressure-released state using an annealing furnace or the like. Continuous molding can be performed by using an annealing furnace. Accordingly, the takt time can be shortened and the productivity can be improved.

Furthermore, as the thermosetting resin, a liquid-like thermosetting resin may also be used. When a liquid-like thermosetting resin is used, a main agent of a liquid-like thermosetting resin and a curing agent are combined and a curing accelerator is usually added, and as necessary, a mold release agent is added. Furthermore, as needed, an organic flame retardant such as a bromide or the like may be mixed prior to use.

The combined liquid-like thermosetting resin and the soft magnetic metal powder mixed in advance are put into a mold for molding using a molding machine. When a solvent is contained, molding is performed after the solvent is volatilized. Alternatively, the solvent is volatilized in advance and the resulting mixture is put into a mold for molding with the use of a molding machine. In such a manner, an antenna core having a desired shape can be produced.

The antenna core of the present invention can be used as an antenna by winding a conductor. For example, a coated conductor subjected to insulation processing in the vicinity of the conductor having copper as a main ingredient is wound around the antenna core, whereby an antenna can be produced. As the winding coated conductor, various conductors known in the appropriate field can be used, but a fusion bondable coated conductor is preferred because the man-hours during winding processing can be reduced. The antenna of the present invention is an antenna for transmitting, receiving and transmitting/receiving an electric wave at a low frequency band of from 10 kHz to 20 MHz and preferably from 30 to 300 kHz.

As described above, embodiments of the present invention were described, but such embodiments are examples of the present invention, and various configurations other than the above embodiments can be adopted.

EXAMPLES

The present invention is now illustrated in detail below with reference to Examples. However, the present invention is not restricted to these Examples.

The shape of a soft magnetic metal powder was measured in the following manner. An average main diameter and an average minor diameter were calculated by analyzing image data resulted from the observation of the shape of a soft magnetic metal powder using a SEM (scanning electron microscope). An average thickness was calculated by analyzing image data resulted from a cross section obtained by embedding the soft magnetic metal powder in a powder-embedded resin and cutting off such a resin using a SEM.

The storage elastic moduli E' (Pa) of antenna cores prepared in Examples and Comparative Examples were measured in the following manner. The prepared antenna core material was cut off in a size of 25 mm×5 mm×1.0 mm, and the cut off material was used as a sample. The storage elastic modulus E' (Pa) was measured by gradually heating the sample from room temperature (30 degrees centigrade) to 250 degrees centigrade at $2.3\times10^9$ Pa at a measurement frequency of 1.0 Hz. As a measuring apparatus, a visco-elastic analyzer RSA-II manufactured by Rheometrics, Inc. was used.

Example 1

In order to clarify the inventive step of the present invention relative to the prior art disclosed in Patent Document 1, a soft magnetic metal powder was prepared in accordance with Example 1 of Patent Document 1. Specifically, an alloy having a composition of $Fe_{66}Ni_4Si_{14}B_9Al_4Nb_3$ was made into a molten metal at 1,300 degrees centigrade using a high frequency melting furnace, and the molten metal was allowed to flow downward through a nozzle equipped at the bottom of the melting furnace. The molten metal was finely granulated using a high pressure argon gas of 75 kg/cm$^2$ from a gas atomizing part installed at a tip end of the nozzle. This finely granulated molten metal per se was allowed to collide against a conical rotating cooler having a roll diameter of 190 mm, a vertical angle of 80 degrees and a rotational speed of 7,200 rpm for quickly cooling, whereby a soft magnetic metal powder having a composition of $Fe_{66}Ni_4Si_{14}B_9Al_4Nb_3$ was prepared. This soft magnetic metal powder was in an oval-spherical flat shape. Specifically, it was a flat soft magnetic metal powder having an average main diameter of 150 μm, an average minor diameter of 55 μm and an average thickness of 2 μm. The ratio (average minor diameter/thickness) was 27.5. The powder X-ray diffraction of this metal powder was measured and as a result, it was confirmed that only a halo pattern of a typical amorphous phase was shown, and it was completely in an amorphous state.

This soft magnetic metal powder was heat-treated in a nitrogen gas atmosphere at 550 degrees centigrade for 1 hour. The powder X-ray diffraction of the soft magnetic metal powder after heat treatment was measured and as a result, a little broad diffraction peak appeared. The crystallite size calculated from a half value width of its peak by the Scherrer formula was nearly 20 nm. Incidentally, a halo pattern indicating an amorphous phase did not fully disappear, and in the soft magnetic metal powder after heat treatment, an amorphous phase and a nanocrystal phase having a crystallite diameter of about 20 nm were present together. The heat treatment temperature was high or the heat treatment time was prolonged for progressing crystallization, whereby the amorphous phase could disappear, but in that case, the crystallite diameter became high, whereby the nanocrystal phase could not exist. To exhibit soft magnetic characteristics suitable as an antenna core, it was important to perform heat treatment such that the crystallite size calculated from the powder X-ray diffraction was about 20 nm.

In this Example, as a binder, a thermosetting resin different from that of Example in Patent Document 1 was used. As the thermosetting resin, an epoxy resin (product name: EOCN-102S manufactured by Nippon Kayaku Co., Ltd.) was used. 61 weight parts of a curing agent (product name: MILEX XCL-4L (modified phenol resin) manufactured by Mitsui Chemicals, Inc.) was added, based on 100 weight parts of the thermosetting resin. Furthermore, as a curing accelerator, 5 weight parts of product name: 3502T manufactured by San-Apro Ltd. based on the epoxy resin and further 5 weight parts of Licowax OP manufactured by Clariant in Japan as a mold release agent were combined for pulverizing and mixing with a mixer.

The previously provided soft magnetic metal powder was treated with a silane coupling agent. Based on 100 weigh parts of the epoxy resin, 5 weight parts of a silane coupling agent (product name: KBM-403 manufactured by Shin-Etsu Chemical Co., Ltd.) was weighed and fully mixed such that the soft magnetic metal powder and the silane coupling agent became uniform. The soft magnetic metal powder mixed with the silane coupling agent was weighed to be a ratio of 83 weight % and mixed for 10 minutes to obtain a uniform powder mixture composed of the soft magnetic metal powder and the thermosetting resin.

The mixers used for mixing up to this operation were all hybrid mixers manufactured by Keyence Corporation. In the following Examples and Comparative Examples, this mixer was also used for mixing.

The powder mixture of the provided soft magnetic metal powder and the thermosetting resin was filled into a mold having a diameter of 30 mm×15 mm. The mold filled with the powder mixture was heated at a temperature of 150 degrees centigrade and pressurized at a pressure of 50 MPa. After 5 minutes, the mold was opened for taking out an antenna core material, and thereafter the antenna core material was annealed in an oven at 180 degrees centigrade for 2 hours.

When the antenna core material was continuously produced, the heat and pressure treatment was performed for 5 minutes, and then the mold was opened for taking out an antenna core material. Immediately thereafter, the next raw powder mixture could be filled into a mold, and continuous production could be easily realized. The takt time was about 7 minutes.

The antenna core material after the annealing treatment at 180 degrees centigrade for 2 hours using an oven was cooled. Thereafter, an antenna core was cut off in a size of 21 mm×3 mm×1 mm. This cut off antenna core was inserted into a bobbin made of a resin having projections at its both ends. A polyurethane coated conductor having a diameter of 0.10 mm was wound around the bobbin with an antenna core inserted thereinto at 1,300 turns to prepare an antenna. LCR meter: HP4284A manufactured by Hewlett-Packard Development Company, L.P. was used for measuring the L value and Q value as antenna characteristics at a frequency of 80 kHz. The antenna was determined to have both of the L value and Q value exhibiting high values as well, and have excellent properties as an antenna. Furthermore, it could be confirmed that the antenna was suitable for continuous production as well. The results are shown in Tables 2 and 3.

Comparative Example 1

The same soft magnetic metal powder as that used in Example 1 was used. The resin used as a binder was the same as that used in Example of Patent Document 1. Specifically, pellets of polyethersulfone manufactured by Mitsui Chemicals, Inc. were frozen and pulverized to prepare a polyethersulfone resin powder having a particle diameter of 100 μm. The soft magnetic metal powder and the resin powder were mixed for 10 minutes such that the soft magnetic metal powder was 81 weight % to prepare a powder mixture of the soft magnetic metal powder and the resin powder. This powder mixture was filled into the mold used in Example 1, heated up to 350 degrees centigrade over 1 hour, and then maintained at 350 degrees centigrade and pressurized at a pressure of 15 MPa for 10 minutes. Thereafter, the powder mixture was cooled down to 150 degrees centigrade for taking out an antenna core material. The resulting antenna core material was used to prepare an antenna in the same manner as in Example 1 for evaluating its properties. The results are shown in Table 2.

Incidentally, 40 minutes were required for cooling the mold in Comparative Example 1 from 350 to 150 degrees centigrade. When the thermoplastic resin was used for continuous production, it could be confirmed that about 50 minutes of the takt time were required.

Comparative Example 2

An antenna core material was prepared in the same manner as in Comparative Example 1 and pressurized at a pressure of 15 MPa at 350 degrees centigrade for 10 minutes. Thereafter, the pressure was released and heating was stopped. At the point of cooling for 10 minutes, the mold was opened for attempting to take out an antenna core material. At the point of cooling for 10 minutes, the mold temperature was 250 degrees centigrade and the antenna core material did not lose fluidity. As a result, the antenna core material was deformed while it was taken out from the mold so that the antenna core in a size of 21 mm×3 mm×1 mm could not be cut off. The results are shown in Table 2.

Example 2

A soft magnetic metal powder was prepared in the same manner as in Example 1, except that a composition of an alloy for preparing a soft magnetic metal powder was changed to $CO_{66}Fe_4Ni_1B_{14}Si_{15}$. Specifically, the finely granulated molten metal was allowed to collide against a rotating cooler for quickly cooling, whereby a soft magnetic metal powder in an oval-spherical flat shape was obtained. The soft magnetic metal powder was in a flat shape having an average main diameter of 70 μm, an average minor diameter of 20 μm and an average thickness of 3 μm. The ratio (an average minor diameter/thickness) was 6.7.

The prepared soft magnetic metal powder was maintained in a stream of nitrogen at a temperature of 380 degrees centigrade for 1 hour, and heat treatment for improving soft magnetic characteristics was carried out. The powder X-ray diffraction of the soft magnetic metal powder after heat treatment was measured. It was confirmed that only a halo pattern specific to the amorphous phase was observed, so the amorphous state was kept.

An antenna core material was prepared in the same manner as in Example 1, except that product name: EOCN-103 manufactured by Nippon Kayaku Co., Ltd. was used as an epoxy resin instead of product name: EOCN-102S manufactured by Nippon Kayaku Co., Ltd. and product name: PN-80 (a polycondensate of phenol and formaldehyde) manufactured by Nippon Kayaku Co., Ltd. was used as a curing agent instead of product name: MILEX XCL-4L manufactured by Mitsui Chemicals, Inc., and the curing agent was used in the amount of 38 weight parts, based on 100 weight parts of the epoxy resin. An antenna was prepared in the same manner as in Example 1 for evaluating its properties. The results are shown in Table 3.

Example 3

An antenna core material was prepared in the same manner as in Example 1 using the same soft magnetic metal powder as that of Example 1, except that product name: EOCN-103 manufactured by Nippon Kayaku Co., Ltd. was used as an epoxy resin and product name: PN-100 (a polycondensate of phenol and formaldehyde) manufactured by Nippon Kayaku Co., Ltd. was used as a curing agent, and the curing agent was used in the amount of 38 weight parts, based on 100 weight parts of the epoxy resin, to give 72 weight % of a ratio of the magnetic metal powder to the binder. An antenna was prepared in the same manner as in Example 1 for evaluating its properties. The results are shown in Table 3.

Example 4

An alloy having a composition of $Fe_{66}Ni_4Si_{14}B_9Al_4Nb_3$ was made into a molten metal at 1,300 degrees centigrade using a high frequency melting furnace. The molten metal was allowed to flow downward through a nozzle equipped at the bottom of the melting furnace, and finely granulated using a high pressure argon gas of 75 kg/cm$^2$ from a gas atomizing part installed at a tip end of the nozzle. According to a water-atomization method comprising dropping this finely granulated molten metal per se against a cooling water bath for quickly cooling, a soft magnetic metal powder having a composition of $Fe_{66}Ni_4Si_{14}B_9Al_4Nb_3$ was obtained. This soft magnetic metal powder had a circular flat shape. Specifically, it was a disk-like soft magnetic metal powder having an average particle diameter of 45 μm, an average thickness of 5 μm and a ratio (an average minor diameter(average particle diameter)/thickness) of 9. This soft magnetic metal powder was heat-treated in a nitrogen gas atmosphere at 400 degrees centigrade for 1 hour. The powder X-ray diffraction of the soft magnetic metal powder after heat treatment was measured. As a result, it could be confirmed that only a halo pattern was observed and the soft magnetic metal powder was in an amorphous state. Furthermore, heat treatment was performed in a nitrogen gas atmosphere at 550 degrees centigrade for 1 hour. Thereafter, the powder X-ray diffraction was measured again. As a result, it was confirmed that a nanocrystal having a crystallite diameter of about 20 nm was precipitated.

An antenna was prepared in the same manner as in Example 1, except that the thus-prepared soft magnetic metal powder was used for evaluating its properties. The results are shown in Table 3.

Example 5

An antenna was prepared in the same manner as in Example 3, except that a ratio of a magnetic metal powder was 83 weight % based on a binder using $Fe_{69}Cu_1Nb_3CR_{1.5}Si_{14}B_{11.5}$ as a soft magnetic metal powder for evaluating its properties. Herein, the soft magnetic metal powder had an oval-spherical flat shape. Specifically, it was in a flat shape having an average main diameter of 41 μm, an average minor diameter of 26 μm and an average thickness of 1.2 μm. The ratio (an average minor diameter/thickness) was 22.

Furthermore, the powder X-ray diffraction after heat treatment for precipitating a nanocrystal was measured. As a result, it was confirmed that the nanocrystal having a crystallite diameter of about 10 nm was precipitated. The results of antenna characteristics are shown in Table 3.

Example 6

An antenna was prepared in the same manner as in Example 3, except that a ratio of a magnetic metal powder was 86 weight % based on a binder using $Fe_{69}Cu_1Nb_3CR_{1.5}Si_{14}B_{11.5}$ as a soft magnetic metal powder for evaluating its properties. Herein, the soft magnetic metal powder was a granular powder. Specifically, it was a granule having an average particle diameter of 7.0 μm. The ratio (an average minor diameter(average particle diameter)/thickness (average particle diameter)) was 1.

Furthermore, the powder X-ray diffraction after heat treatment for precipitating a nanocrystal was measured. As a result, it was confirmed that the nanocrystal having a crystallite diameter of about 10 nm was precipitated. The results of antenna characteristics are shown in Table 3.

Comparative Example 3

An experiment for comparing with antenna performances as described in Patent Document 2 was conducted. In Example as described in Patent Document 2, it was difficult to mention that a magnetic powder and an organic binder in use were sufficiently specifically described. However, among those belonging to a category of the "Fe—Al—Si alloy" as described in Example of Patent Document 2, as a sendust alloy ($Fe_{85}Si_{10}Al_5$) having singularly high magnetic permeability and suitably used for an antenna core, a soft magnetic metal powder having an average particle diameter of 10 μm of a sendust powder (product name: SFR-FeSiAl manufactured by Nippon Atomized Metal Powders Corporation) was used.

An antenna was prepared in the same manner as in Example 3, except that SFR-FeSiAl was used as a soft magnetic metal powder, and a ratio of the soft magnetic metal powder was 85 weight % based on a binder, and its properties were evaluated. Its results are shown in Table 2. The L value of the antenna prepared in Comparative Example 3 was about ⅓ as compared to that of Example of the present invention, while the Q value was about a half as compared to that of Example of the present invention. Accordingly, it could be confirmed that antenna characteristics were deteriorated about ⅙.

Example 7

Furthermore, an antenna core material of 25 mm×5 mm×1.0 mm was prepared by using the same material and method as in those of Example 5. The storage elastic modulus E' (Pa) was measured by gradually heating this antenna core material from room temperature (30 degrees centigrade) to 250 degrees centigrade at $2.3\times10^9$ Pa at a measurement frequency of 1.0 Hz. The storage elastic modulus E' was 2.33 GPa at 30 degrees centigrade, 2.28 GPa at 80 degrees centigrade and 2.27 GPa at 100 degrees centigrade. Even though the temperature was gradually elevated from room temperature, the elastic modulus of the antenna core in this Example was almost constant. Accordingly, the antenna core in this Example was hardly deformed even at a high temperature and excellent in the dimensional stability by combining a specific soft magnetic metal powder and a thermosetting resin. Further, it could be confirmed that the antenna core excellent in soft magnetic characteristics and the productivity at the same time was achieved. The results are shown in Table 1.

Even though the same material and method as those of Examples 1 to 4 and 6 were used, the storage elastic modulus E' of the antenna core was the same value as that of Example 7. On the other hand, according to the conventional technical knowledge, the antenna core in Comparative Example using a thermoplastic resin as a binder may be easily deformed at a high temperature and may have worse heat resistance. Furthermore, the antenna core using a thermoplastic resin easily causes a change in magnetic characteristics attributed to deformation.

TABLE 2

| | Binder | L value [/mH] | Q value | Takt time | Moldability |
|---|---|---|---|---|---|
| Example 1 | Thermosetting resin | 17.5 | 70 | 7 min. | Good |
| Comparative Example 1 | Thermoplastic resin | 15.0 | 66 | 50 min. | Good |
| Comparative Example 2 | Thermoplastic resin | — | — | 20 min. | Bad |

As clear from the comparison of Example 1 to Comparative Example 1 and Comparative Example 2 illustrated in Table 2, a high performance antenna core could be produced with a high productivity by using the thermosetting resin of the present invention as a binder.

Furthermore, from the comparison of Examples to Comparative Example illustrated in Table 3, an antenna excellent in antenna characteristics could be provided by using the specific soft magnetic material powder of the present invention as compared to the prior art.

TABLE 3

| | Soft magnetic metal powder | | | | | Antenna performance | |
|---|---|---|---|---|---|---|---|
| | | | Particle shape | | | L | |
| | Composition | Crystallinity | Main diameter | Minor diameter | Thickness | value [/mH] | Q value |
| Example 1 | Fe66Ni4Si14B9Al4Nb3 | nanocrystal | 150 μm | 55 μm | 2 μm | 17.5 | 70 |
| Example 2 | Co66Fe4Ni1B14Si15 | amorphous | 70 μm | 20 μm | 3 μm | 17.0 | 69 |
| Example 3 | Fe66Ni4Si14B9Al4Nb3 | nanocrystal | 150 μm | 55 μm | 2 μm | 16.1 | 65 |
| Example 4 | Fe66Ni4Si14B9Al4Nb3 | nanocrystal | 45 μm | | 5 μm | 16.3 | 65 |
| Example 5 | Fe69Cu1Nb3Cr1.5Si14B11.5 | nanocrystal | 41 μm | 26 μm | 1.2 μm | 16.5 | 66 |
| Example 6 | Fe69Cu1Nb3Cr1.5Si14B11.5 | nanocrystal | | 7.0 μm | | 11.2 | 63 |
| Comparative Example 3 | Fe85Si10Al5 | crystal | | 10 μm | | 5.5 | 38 |

INDUSTRIAL APPLICABILITY

The antenna core of the present invention is suitable for use in a small-sized antenna. In particular, the antenna core is suitably used for an antenna for transmitting and receiving an electric wave at a frequency range of 10 kHz to 20 MHz called a low frequency (LF) band.

As the applications of the antenna core and the antenna of the present invention, there can be exemplified a keyless entry system for automobile/immobilizer, a tire pressure monitoring system (TPMS), a radio frequency identification (RFID) system, an electronic article surveillance (EAS) system, an electronic key, an electric wave clock and the like. According to the present invention, it is possible to provide these systems in a small size at a low cost.

The invention claimed is:

1. An antenna core produced by shaping a soft magnetic metal powder with the use of a resin as a binder, wherein the soft magnetic metal powder is a nanocrystal-containing amorphous soft magnetic metal powder represented by the general formula (2) and formed by heat-treating the soft magnetic metal powder, $$(Fe_{1-x}M'_x)_{100-a-b-c-d}Si_aAl_bB_cM_d \quad (2)$$

wherein, in the formula (2), M' is Co and/or Ni; M is at least one element selected from the group consisting of Nb, Mo, Zr, W, Ta, Hf, Ti, V, Cr, Mn, Y, Pd, Ru, Ga, Ge, C, P, Cu, Au, Ag, Sn and Sb; and x represents an atomic ratio and each of a, b, c and d represents an atomic %, satisfying the relationships: $0\leqq x\leqq 0.5$, $0\leqq a\leqq 24$, $0\leqq b\leqq 20$, $1\leqq c\leqq 30$, $0\leqq d\leqq 10$ and $2\leqq a+c\leqq 30$, and wherein the nanocrystal has a crystallite diameter of not more than 30 nm.

2. The antenna core according to claim 1, wherein the nanocrystal-containing amorphous soft magnetic metal powder is a nanocrystal-containing amorphous soft magnetic metal powder obtained by heat treating the soft magnetic metal powder in an inert gas atmosphere in the temperature range of 300 to 700 degrees centigrade for 1 second to 10 hours.

3. The antenna core according to claim 1, wherein the soft magnetic metal powder is a soft magnetic metal powder having a flat shape.

4. The antenna core according to claim 1, wherein the thermosetting resin is at least one selected from the group consisting of an epoxy resin, a phenol resin, an unsaturated polyester resin, a urethane resin, a urea resin, a melamine resin and a silicon resin.

5. The antenna core according to claim 1, wherein the storage elastic modulus E' at 80 degrees centigrade is from 0.1 to 20 GPa at a measurement frequency of 1.0 Hz.

6. An antenna formed by winding a conductor around the antenna core according to claim 1.

7. The antenna according to claim 6, wherein the antenna is an antenna for transmitting, receiving or transmitting/receiving an electric wave in a low frequency band of 10 kHz to 20 MHz.

8. A keyless entry system for automobile, wherein the antenna according to claim 6 is used as a transmission antenna, a reception antenna or a transmission/reception antenna.

9. A tire pressure monitoring system, wherein the antenna according to claim 6 is used as a transmission antenna, a reception antenna or a transmission/reception antenna.

10. An electric wave clock, wherein the antenna according to claim 6 is used as a reception antenna.

11. A radio frequency identification system, wherein the antenna according to claim 6 is used as a transmission antenna, a reception antenna or a transmission/reception antenna.

12. An electronic article surveillance system, wherein the antenna according to claim 6 is used as a transmission antenna, a reception antenna or a transmission/reception antenna.

13. A method for producing an antenna core comprising a nanocrystal-containing amorphous soft magnetic material powder represented by the general formula (2):

$$(Fe_{1-x}M'_x)_{100-a-b-c-d}Si_aAl_bB_cM_d$$

wherein, in the formula (2), M' is Co and/or Ni; M is at least one element selected from the group consisting of Nb, Mo, Zr, W, Ta, Hf, Ti, V, Cr, Mn, Y, Pd, Ru, Ga, Ge, C, P, Cu, Au, Ag, Sn and Sb; and x represents an atomic ratio and each of a, b, c and d represents an atomic %, satisfying the relationships: $0 \leqq x \leqq 0.5$, $4 \leqq a \leqq 24$, $0 \leqq b \leqq 20$, $1 \leqq c \leqq 30$, $0 \leqq d \leqq 10$ and $2 \leqq a+c \leqq 30$;

wherein the method comprises heat treating a soft magnetic metal powder in an inert gas atmosphere in the temperature range of 300 to 700 degrees centigrade for 1 second to 10 hours to obtain the nanocrystal-containing amorphous soft magnetic material powder; and shaping the nanocrystal-containing amorphous soft magnetic material powder with the use of a resin as a binder to obtain the antenna core wherein the nanocrystal has a crystallite diameter of not more than 30 nm.

* * * * *